United States Patent [19]

Mrenna et al.

[11] 4,266,210

[45] May 5, 1981

[54] CIRCUIT BREAKER WITH IMPROVED ARC EXTINGUISHING MEANS

[75] Inventors: Stephen A. Mrenna, Brighton Township, Beaver County; James P. Ellsworth, Beaver, both of Pa.

[73] Assignee: Westinghouse Electric Corp., Pittsburgh, Pa.

[21] Appl. No.: 73,821

[22] Filed: Sep. 10, 1979

[51] Int. Cl.[3] ..... H01H 9/30

[52] U.S. Cl. ..... 335/201; 200/147 R

[58] Field of Search ..... 335/35, 36, 38, 201; 200/147 R

[56] References Cited

U.S. PATENT DOCUMENTS 4,056,798 11/1977 Malick ..... 335/201 X 4,149,129 4/1979 Andersen et al. ..... 335/201 X

*Primary Examiner*—George Harris

*Attorney, Agent, or Firm*—W. A. Elchik; M. J. Moran; B. Hudson, Jr.

[57] ABSTRACT

This invention relates to circuit breakers and more particularly to circuit breakers for industrial power circuits with 10,000 amp interrupting capacity and 240 V ratings. This invention provides a novel arc shield arrangement whereby two arc shields are placed in series alignment with a small air gap between the shield. The effect of this new arrangement increases the arc voltage and arc braking distance and yet the air gap is kept small enough to keep the arc within the shielding and away from other components where it can cause damage.

2 Claims, 5 Drawing Figures

CIRCUIT BREAKER WITH IMPROVED ARC EXTINGUISHING MEANS

BACKGROUND OF THE INVENTION

1. Field of the Invention

This invention relates generally to circuit breakers and more particularly to circuit breakers for industrial power circuits with 10,000 amp interrupting capacity and 240 V ratings.

2. Description of the Prior Art

Circuit breakers must carry normal load currents without overheating and must open overload and short circuit currents repetitively without serious damage to its contacts and other internal components that can be caused by arcing. Increasing load requirements have placed a greater burden on circuit breaker designers to develop more effective circuit breakers which can interrupt higher overload and short circuit currents repetitively and yet maintain minimal size requirements and low cost construction. Although it is old to apply an arc shield to extinguish arcs, higher interrupting requirements of circuit breakers has made the more conventional type de-ion arc plates and other conventional shielding designs ineffective in extinguishing the arc and protecting the other breaker components.

SUMMARY OF THE INVENTION

The object of this invention is to provide a novel and unique arc shield arrangement for quickly extinguishing arcs in circuit breakers with high current interrupting capabilities. This novel arc shield arrangement splits the arc generated into smaller arcs for more effective extinguishing action and prevents the arc from blowing up into the interior of the breaker causing extensive damage to other components. Extensive experimentation has shown that at higher current ratings such as 10,000 and, 240 volts conventional arc extinguishing methods were ineffective. The object of this invention is to place two arc shields in series with a small air gap between the shields. The effect of this new arrangement increases the arc voltage and arc breaking distance and yet the air gap is kept small enough to keep the arc within the shielding and away from other components where it can cause damage.

DESCRIPTION OF THE PREFERRED EMBODIMENT

Figure 1:
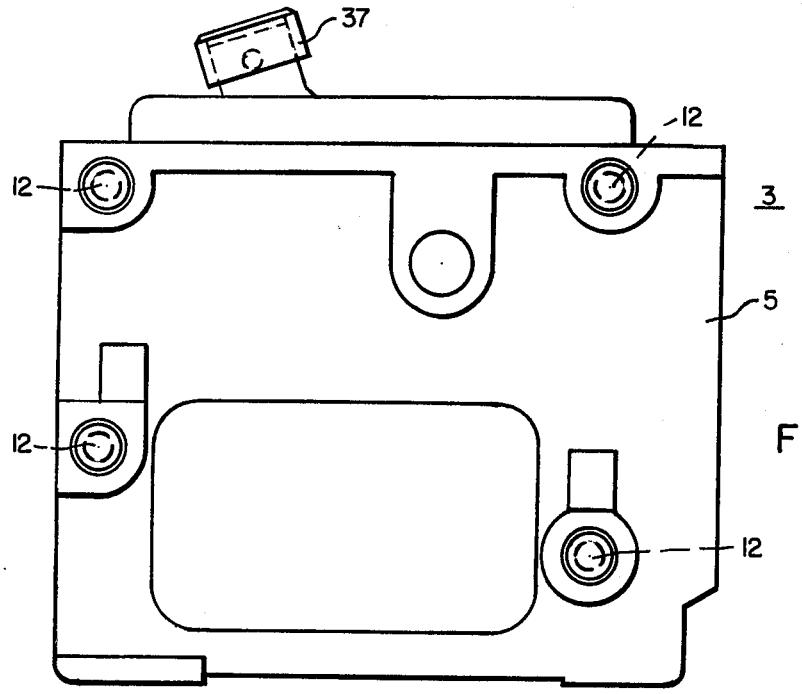
FIG. 1 is a front view of a circuit breaker structure which incorporates the principles of this invention.
Figure 4:
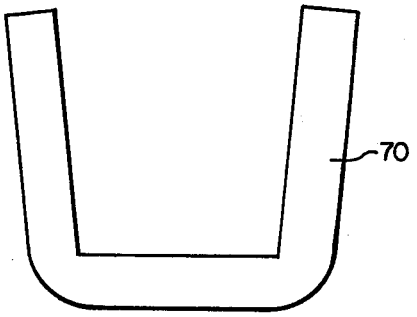
FIGS. 4 and 5 are isolated views of the arc shield in accordance with the principles of this invention.
Figure 5:
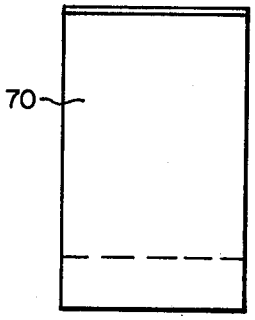
Figure 2:
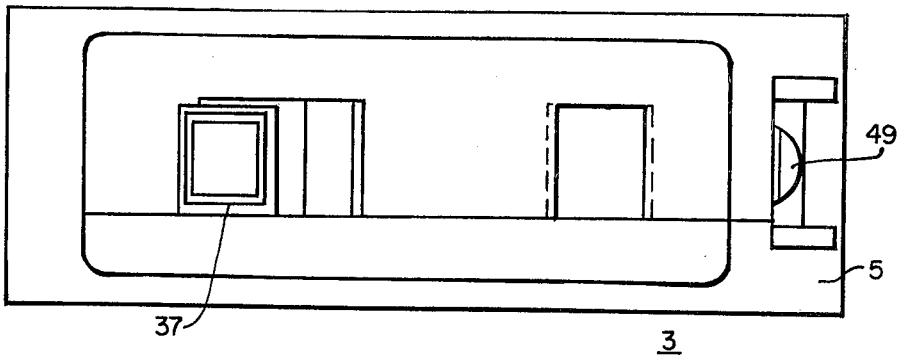
FIG. 2 is a top view of the circuit breaker structure shown in FIG. 1.
Figure 3:
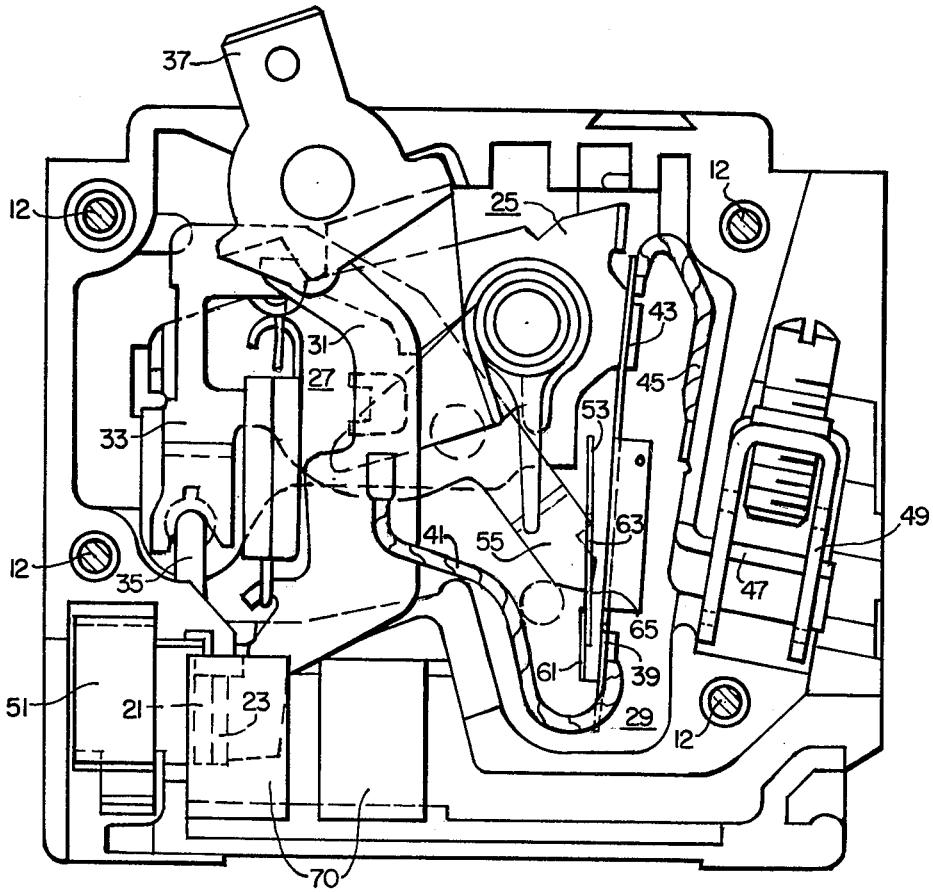
FIG. 3 is a vertical sectional view taken along the line I—I of FIG. 2 showing the circuit breaker mechanism in the closed position.

In FIG. 1 a circuit breaker structure is generally indicated at 3 and it comprises a housing 5 which is composed of electrically insulating material such as thermosetting resin. Inasmuch as a detailed description of the circuit breaker is of the type disclosed in U.S. Pat. No. 3,566,318 issued Feb. 23, 1971, to F. L. Gelzheiser et al., to which reference is made for complete description of structure and operation, the description of those portions is limited to the parts that are essential to the operation of the invention disclosed herein. Briefly, as shown in FIG. 3 the circuit breaker mechanism comprises a stationary contact 21, a movable contact 23, a supporting metal frame 25, an operating mechanism 27, and a trip device 29. Among other things the operating mechanism 27 comprises a contact arm 31 and a releasable member 33 which is pivotally supported at one end thereof on a pivot 35 when the circuit breaker is open manually. A handle 37 is rotated from the "ON" to the "OFF" position, whereby the contact arm 31 moves the movable contact 23 away from the stationary contact 21 in a conventional manner.

The contact arm 31 is electrically connected to the lower end of an elongated bi-metal element or bi-metal 39 by a flexible conductor 41. The bi-metal 39 is part of the trip device 29 and is secured at the upper end to a flange 43 of the frame 25. A flexible conductor 45 connects the upper end of the bi-metal 39 with a terminal strap 45 having a terminal connector 47. Thus, the closed circuit through the circuit breaker extends from a terminal 51 through the stationary contact 21, the movable contact 23, the contact arm 31, the flexible conductor 41, the bi-metal 39, the flexible conductor 45, the terminal strap 47, to the terminal connector 49.

The trip device 29 comprises a bi-metal 39, an elongated rigid magnetic armature or latch member 53, and an end portion 55 of the releasable member 33. The latch member 53 was mounted on the upper end of a flexible metal strip 61, the lower end of which is secured to the lower end of the bi-metal 39 in a suitable manner such as a spot weld. As shown in FIG. 3, the latch member 53 has an opening 63 which includes a latch surface 65 at the base of the opening in the reset position of the circuit breaker as shown in the drawings. The end portion 55, the releasable member 33 is latched in the opening 63 of the latch member 53, and more particularly, is lodged upon the latch surface 65. Upon the occurrence of a sustained overload current above a first predetermined value the bi-metal 39 which is heated by the current flowing therefrom, deflects from the position shown in FIG. 3 to a thermally tripped position to the right of that shown in FIG. 3, whereupon the end portion 55 drops from its position on the latch surface 65.

In accordance with the principles of this invention there is in FIG. 3 shown two generally U-shaped ferromagnetic steel arc shields 70 mounted in series, the shields being separated by 0.094 inch disposed with the contacts 21 and 23 being in the bight portion thereof, and said shields being mounted in the molded insulating housing. Because these shields are ferromagnetic they pull the arc away from the interior of the circuit breaker and the gap between them splits the arcs into smaller arcs for more effective extinguishing action thus preventing the arc from causing extensive damage to other breaker components.

We claim:

1. A circuit breaker comprising a molded insulated housing, mounted within the housing a pair of separable contacts operable between opened and closed positions, a releasable member in an initial position and movable when released to a trip position to effect automatic opening of the contacts, said breaker further comprising tripping means for effecting release of the releasable member when a predetermined overload current is sensed by the tripping means, two ferromagnetic generally U-shaped arc shields mounted in proximity to the separable contacts and disposed such that one of said separable contacts moves generally through the arc shields, the arc shields being disposed to split the arc into smaller arcs for more effective arc extinguishing action, and to draw the arcs away from other interior circuit breaker components.

2. A circuit breaker as recited in claim 1 where said generally U-shaped arc shields are mounted in series alignment, the shields having a small air gap between them, and being mounted on the molded insulating housing.

* * * * *